United States Patent [19]

Healey

[11] 4,330,151

[45] May 18, 1982

[54] MULTI-PURPOSE ADJUSTABLE TABLE AND BENCH DEVICE

[76] Inventor: Robert W. Healey, 420 Sycamore Rd., DeKalb, Ill. 60115

[21] Appl. No.: 148,545

[22] Filed: May 9, 1980

[51] Int. Cl.[3] ..... A47B 39/00; A47B 83/02

[52] U.S. Cl. ..... 297/157; 297/119; 108/97; 182/132

[58] Field of Search ..... 297/157, 119, 121, 174, 297/139; 108/97, 101; 248/354 D; 182/132, 179

[56] References Cited

U.S. PATENT DOCUMENTS

| | | | |
|---|---|---|---|
| 795,451 | 7/1905 | Rice | 182/132 X |
| 1,044,889 | 11/1912 | Hyde | 182/132 X |
| 1,702,170 | 2/1929 | Pieri | 108/17 |
| 1,730,618 | 10/1929 | Mayo | 248/354 |
| 2,362,567 | 11/1944 | LaRue | 155/124 |
| 2,411,658 | 11/1946 | LaRue | 297/159 |
| 2,594,605 | 4/1952 | Zoppelt | 248/354 P |
| 2,694,609 | 11/1954 | Trafford | 311/4 |
| 2,704,236 | 4/1955 | Mahr | 311/68 |
| 2,836,475 | 5/1958 | Sapp | 311/4 |
| 2,851,311 | 4/1955 | Gibbs | 182/122 X |
| 2,978,754 | 3/1961 | Wilson | 20/1.123 |
| 3,071,204 | 1/1963 | Piltingsrud | 182/179 X |
| 3,096,866 | 7/1963 | Glass | 297/150 |
| 3,262,734 | 7/1966 | Kuks | 297/157 |
| 3,636,892 | 1/1972 | Linton | 108/79 |
| 3,850,264 | 11/1974 | Salinas | 182/132 |
| 3,866,548 | 2/1975 | Skonieczny | 108/79 |
| 4,102,086 | 7/1978 | Korman | 52/9 |

*Primary Examiner*—Ronald Feldbaum

*Attorney, Agent, or Firm*—Fitch, Even, Tabin, Flannery & Welsh

[57] ABSTRACT

This disclosure describes a multi-purpose adjustable table and bench device having a table top and benches all with adjustable heights so that the device can be used, for example, either as a table with benches attached on either side for sitting, or as a platform. Means are provided to secure two or more table and bench devices together to create larger table and bench arrangements, or stage areas in various configurations.

6 Claims, 6 Drawing Figures

MULTI-PURPOSE ADJUSTABLE TABLE AND BENCH DEVICE

The present invention relates to the art of tables and the like, especially tables with attached benches, and stage or platform units.

In schools, churches, and other organizations, there often exists a need for portable tables which can be utilized as eating or writing surfaces where several people can be seated. The same organizations often need a portable stage or platform area for plays, skits, assembly programs, presentations and related uses. However, these organizations are often limited in the amount of available funds which does not justify the additional expense of purchasing a separate stage system. Further, there is often limited storage space available for storing the separate stage system when not in use.

Therefore, it is an object of the present invention to provide a plurality of multi-purpose adjustable table and bench devices which can be converted into a portable stage or platform.

Other objects of the present invention, in addition to those set forth above, will become apparent to those skilled in the art from the following description taken in connection with the accompanying drawings.

Very generally, a multi-purpose adjustable table and bench device constructed in accordance with the present invention comprises a generally rectangular shaped first member having a generally flat top planar surface, and a pair of generally rectangular shaped second members each having a generally flat top planar surface. Support means are provided for supporting the first member and the pair of second members, wherein the generally flat top planar surface of the first member is generally horizontally disposed a predetermined distance above the ground, and the generally flat planar surface of each of the second members are each horizontally disposed a predetermined distance above the ground, and the pair of second members are disposed on opposite sides of the first member in a parallel array. Adjustable means are provided for adjusting the relative distance between the top planar surfaces of each of the pair of second members and the top planar surface of the first member. Means are also provided for securely attaching the table and bench devices to one or more similar table and bench devices, whereby the table and bench devices can be used as a stage or platform.

Figure 1:
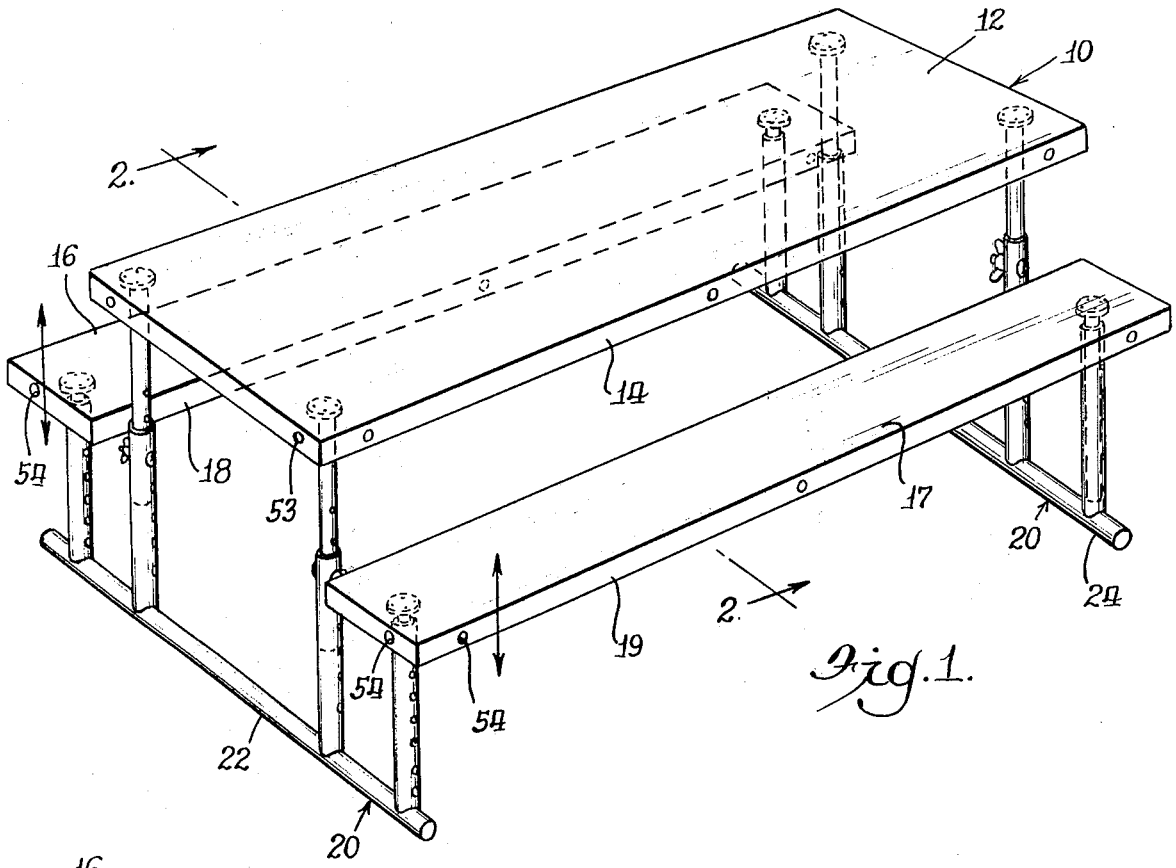
FIG. 1 is a perspective view of an adjustable table with attached benches constructed according to the present invention.

More specifically, in the Figures there is shown a multi-purpose adjustable table and bench device 10 constructed according to the present invention. In FIG. 1, the table and bench device 10 is shown adjusted to be used as a table with benches attached along either side of the table for sitting. The table and bench device 10 comprises rectangular table top 12 having a flange 14 which extends around the edges of the table top 12, and a pair of rectangular benches 16 and 17 each having respectively flanges 18 and 19 which extend respectively around the edges of the benches 16 and 17. The table top 12 and benches 16 and 17 are supported by an adjustable support member 20 specifically shown in FIG. 1 which allow the relative height of the table top 12 and the benches 16 and 17 to be adjusted so that the table and bench device 10 can be used either as a table with attached benches, or as a portion of a stage unit.

Figure 2:
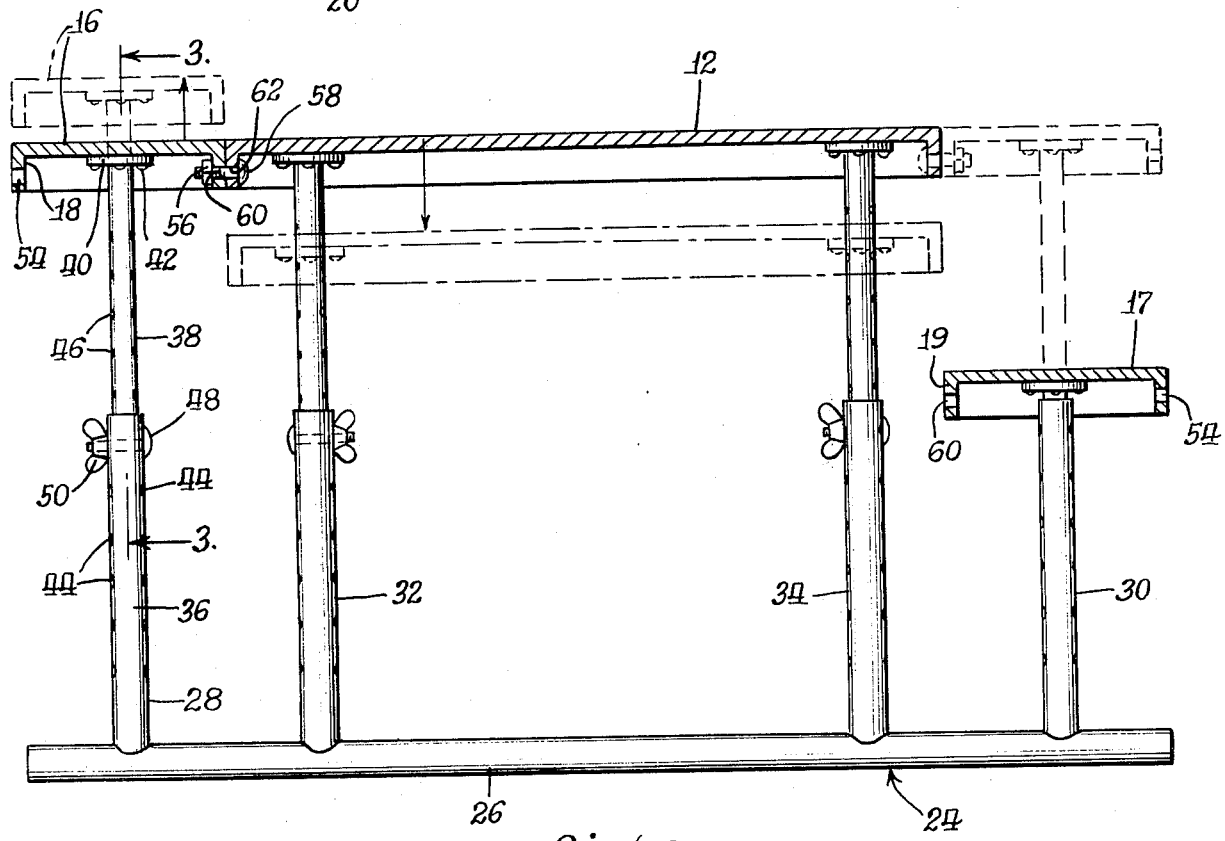
FIG. 2 is a sectional view taken generally along lines 2—2 in FIG. 1 showing the table top and benches in various positions.

The adjustable support member 20 comprises a pair of identically constructed support members 22 and 24 attached to opposite sides of the table top 12 and benches 16 and 17. Since the support members 22 and 24 are identically structured, only support member 24 will be described. Referring to FIG. 2, support member 24 comprises tubular member 26, which extends along the floor with four identically structured adjustable legs 28, 30, 32, and 34 disposed parallel to each other and securely attached perpendicular to the axis of tubular member 26. Each of the outer legs 28 and 30 is attached respectively to the bottom of one end of the benches 16 and 17, and each of the inner legs 32 and 34 are attached to opposite sides of the bottom of the table top 12. All of the legs 28, 30, 32 and 34 are adjustable whereby the height of the table 12 and the heights of the benches 16 and 17 can be varied. Since the structure of the legs 28, 30, 32 and 34 are identical, only the structure of the leg 28 will be described.

Figure 4:
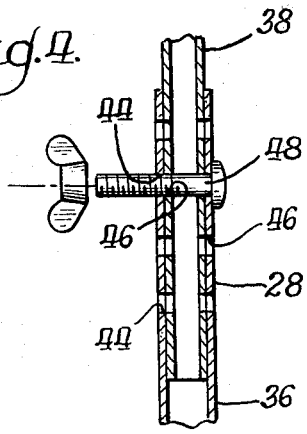
FIG. 4 is a partial sectional view taken generally along lines 4—4 in FIG. 3.
Figure 3:
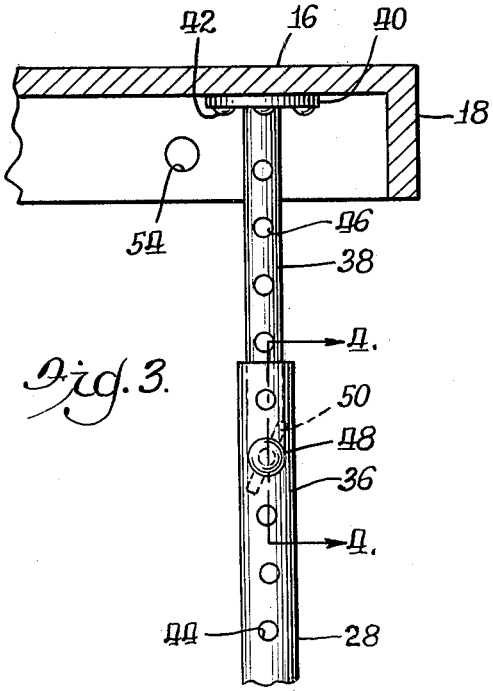
FIG. 3 is a partial sectional view taken generally along lines 3—3 in FIG. 2.

Referring specifically to FIGS. 2, 3 and 4, the leg 28 comprises a tubular pipe sleeve 36 securely attached at one end to the tubular member 26, and a tubular pipe insert 38 having a length approximately equal to the length of the pipe sleeve 36. The pipe insert 38 is slidably engaged in the interior and extends out the other end of the pipe sleeve 36. This allows for the adjustment of the height of the bench 16. Attached perpendicularly to the distal portion of the pipe insert 38 is a flange 40 which is used to secure the pipe insert 38 with screws 42 to the bottom of the bench 16.

Both the pipe sleeve 36 and the pipe insert 38 have respectively a plurality of pairs of holes 44 and 46 which extends through their walls which allow the insertion of a heavy stress steel bolt 48 through the holes to lock the height of the bench 16 at various levels. A wing nut 50 is provided to secure the bolt 48 to the pipe sleeve 36 thereby locking the height of the bench 16. In a similar manner, the heights of the bench 17 and the table top 12 can also be adjusted as can be seen in FIG. 2.

Figure 6:
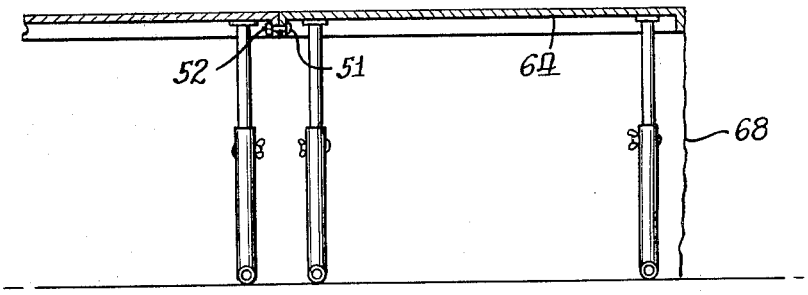
FIG. 6 is a partial sectional view taken generally along lines 6—6 in FIG. 5.
Figure 5:
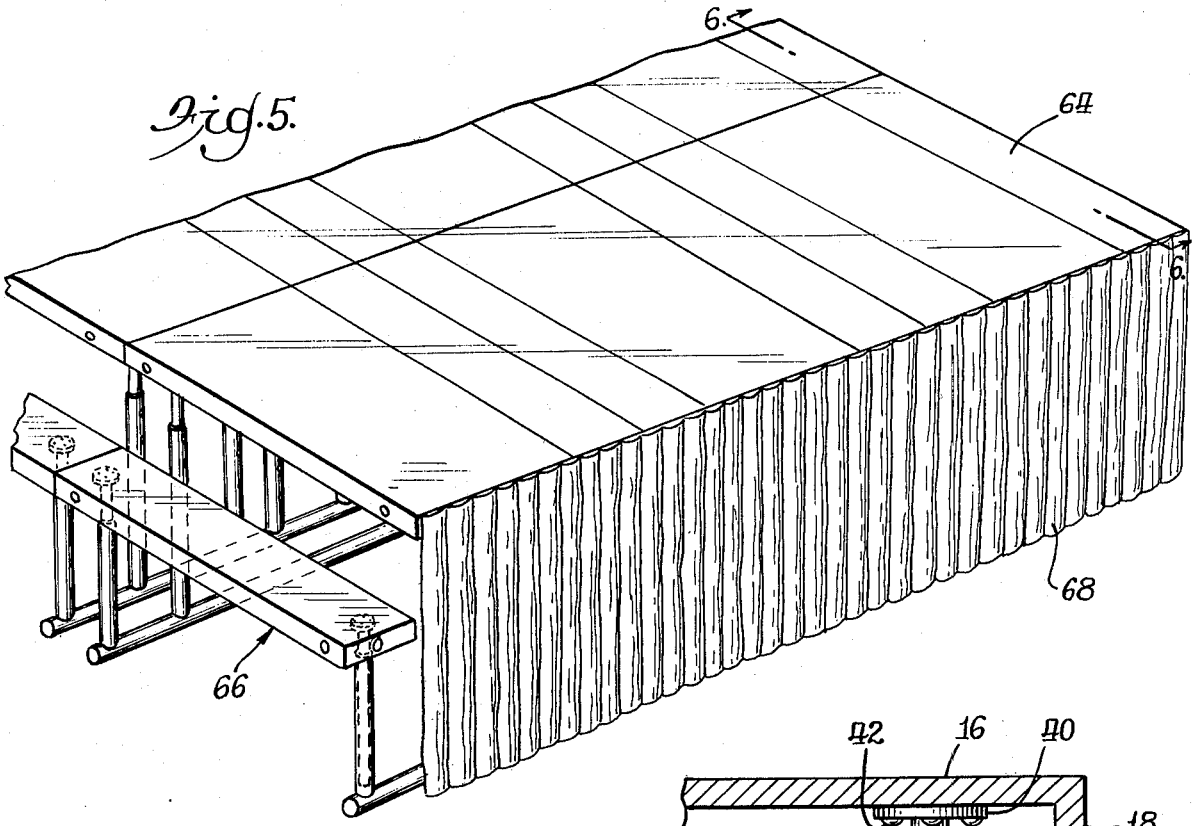
FIG. 5 is a broken away perspective view of a stage constructed according to the present invention.

In accordance with a further aspect of the present invention, means are provided for securing a plurality of table and bench devices 10 together, as for example illustrated in FIGS. 5 and 6, to be used as a stage unit in various configuration. To this end in the illustrated embodiment of the present invention the flange 14 of the table top 12 and the flanges 18 and 19 of the benches 16 and 17 are included to provide appropriate surfaces which allow several table and bench devices to be fastened together by bolts 51 and nuts 52. The bolts 51 can extend through a plurality of holes 53 which extend perpendicularly through the flange 24 of the table top 12 and/or a plurality of holes 54 which extend perpendicularly through the flanges 18 and 19 of the benches 16 and 17 for securing two or more of the adjustable table and bench devices 10 together to form various larger table or stage configuration.

It is noted that the flange 14 extends entirely around the edge of the table top 12 and the flanges 18 and 19 respectively extend entirely around the edges of the benches 16 and 17. This is done to provide appropriate surfaces so that when the table top and benches are adjusted to form a single top planar surface they can be secured together to form a more stable structure. For example, in FIG. 2, bench 16 is adjusted to form a single planar surface with the table top 12 with a portion of flange 14 butting against flange 18. The flanges 14 and 18 are secured together by a nut 56 and a bolt 58 which extend through a hole 60 in the flange 18 and a hole 62 in the flange 14.

In accordance with a further aspect of the present invention, FIG. 5 shows one arrangement wherein several devices of the present invention are attached together and adjusted to create a stage area 64 and a step 66 leading up to the stage 64. A drape 68 is shown extending along the edge of the stage area 64 and is shown for illustrative purposes. All of the adjustable table and bench devices are connected together by the means previously described to create a stable structure suitable for use as a stage, for example, for use in a school or church.

FIG. 6 is a cross-sectional view taken along lines 6—6 in FIG. 5 and shows how the benches of two of the table and bench devices are adjusted to extend to the same height and are securely bolted together.

Although not specifically shown in the Figures, several table and bench devices could also be adjusted and secured together to create a stage area with a row of elevated seats which extend above the stage area. Also, although not shown in the figures, each table and bench device can be designed to fold in the middle for easy storage in an upright position. These and all other configurations which would be obvious to one skilled in the art after reading this disclosure are considered to fall under the scope of the present invention.

From the foregoing, it should be appreciated that novel multi-purpose adjustable table and bench devices are disclosed which can quickly be adjusted in various configurations for use as either tables with attached benches, or for use as stage areas in various configurations. These devices are especially useful for use in organizations such as schools or churches where space is at a premium, and the added cost of having both a separate stage and separate tables with attached benches is not economically feasible.

It should be understood that although certain preferred embodiments of the present invention have been illustrated and described, various modifications, alternatives and equivalents thereof will become apparent to those skilled in the art and, accordingly, the scope of the present invention should be defined only by the appended claims and equivalents thereof. Various features of the invention are set forth in the following claims.

What is claimed is:

1. A multi-purpose adjustable table and bench device convertible to a stage comprising:

a generally rectangular shaped first member having a generally flat top planar surface;

a pair of generally rectangular shaped second members each having a generally flat top planar surface;

supporting means for supporting the first member and the pair of second members wherein the generally flat top planar surface of the first member is generally horizontally disposed a predetermined distance above the ground, and the generally flat planar surfaces of each of the second members are each horizontally disposed a predetermined distance above the ground, and the pair of second members are disposed on opposite sides of the first member in a parallel array;

adjusting means for adjusting the relative distance between the planar surfaces of each of the pair of second members and the planar surface of the first member; and first securing means for securely attaching the table and bench device to one or more similar table and bench devices.

2. The table and bench device of claim 1 wherein the adjusting means can be adjusted so that the flat top planar surface of each of the pair of second members is coplanar with the flat top planar surface of the first member.

3. The table and bench device of claim 1 wherein the adjusting means can be adjusted so that the flat top planar surface of one of the pair of second members is greater than the height of the flat top planar surface of the first member.

4. The table and bench device of claim 1 wherein the means can be adjusted so that the flat top planar surface of each of the pair of second members is greater than the height of the flat top planar surface of the first member.

5. The table and bench device of claim 1 further comprising second securing means for securing one of said second members to said first member when the adjusting means are adjusted so the flat top planar surface of the second member is coplanar with the flat top planar surface of the first member.

6. The table and bench device of claim 5 wherein the second securing means comprises a first flange attached to the edge of the first member, a second flange attached to the edge of the second member, and means for securing the first and second flange together when the adjusting means are adjusted so the flat top planar surface of the second member is coplanar with the flat top planar surface of the first member.

* * * * *